US008435926B2

(12) United States Patent
Iwaoka et al.

(10) Patent No.: US 8,435,926 B2
(45) Date of Patent: May 7, 2013

(54) THERMAL TRANSFER SHEET

(75) Inventors: Sakie Iwaoka, Tokyo (JP); Yasushi Yoneyama, Tokyo (JP); Daisuke Fukui, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 236 days.

(21) Appl. No.: 13/120,836

(22) PCT Filed: Dec. 12, 2008

(86) PCT No.: PCT/JP2008/072692

§ 371 (c)(1), (2), (4) Date: May 13, 2011

(87) PCT Pub. No.: WO2010/035354

PCT Pub. Date: Apr. 1, 2010

(65) Prior Publication Data

US 2011/0265977 A1 Nov. 3, 2011

(30) Foreign Application Priority Data

Sep. 25, 2008 (JP) ..... 2008-246458

(51) Int. Cl.
*B41M 5/40* (2006.01)

(52) U.S. Cl.
USPC ..... 503/227; 428/32.68

(58) Field of Classification Search ..... None
See application file for complete search history.

(56) References Cited

FOREIGN PATENT DOCUMENTS

| | | |
|---|---|---|
| JP | 61-14983 | 1/1986 |
| JP | 7-314929 | 12/1995 |
| JP | 2001-334760 | 12/2001 |

*Primary Examiner* — Bruce H Hess
(74) *Attorney, Agent, or Firm* — Novak Druce Connolly Bove + Quigg LLP

(57) ABSTRACT

The present invention provides a thermal transfer sheet that has good heat resistance and slip property, and prevents the occurrence of tailing upon printing to achieve good printing even in high-speed printing.

A thermal transfer sheet including: a base material; a color material layer on one surface of the base material; and a heat resistant slipping layer on the other surface of the base material, wherein the heat resistant slipping layer includes a polyamide resin, a silicone-modified polyamide resin, and an ethoxylated alcohol-modified wax.

20 Claims, No Drawings

THERMAL TRANSFER SHEET

CROSS REFERENCE TO RELATED APPLICATIONS

This application is a National Phase filing under 35 U.S.C. §371 of PCT/JP2008/072692 filed on Dec. 12, 2008; and this application claims priority to Application No. 2008-246458 filed in Japan on Sep. 25, 2008 under 35 U.S.C. §119; the entire contents of all are hereby incorporated by reference.

TECHNICAL FIELD

The present invention relates to a thermal transfer sheet.

BACKGROUND ART

Thermal transfer printers generally print images using a line-type thermal head including heat generators arrayed in a line, specifically by applying heat to a thermal transfer sheet and a receiving material in overlap while moving them in the direction perpendicular to the longitudinal direction of the thermal head.

Thermal transfer sheets that are used for such image-printing include a heat resistant slipping layer, and the heat resistant slipping layer is formed on a surface of a base material that is to be in contact with a thermal head for the purpose of improving heat resistance and ensuring traveling stability by adding slip property. Recently, an increase in printing speed of printers has resulted in an increase in thermal energy applied by a thermal head. Therefore, the thermal transfer sheets are required to have better heat resistance and slip property.

Various methods of forming the above heat resistant slipping layer have been known.

For example, Patent Document 1 discloses a method of forming a heat-resistant layer of a high heat-resistant thermosetting resin. In this method, however, the heat resistance is improved, but the slip property for a thermal head is insufficiently improved. Further, this method involves use of a curing agent such as a cross-linking agent, and therefore, two-part coating liquid is needed. This poses problems such as pot life. In addition, since a plastic thin film, which can not undergo high-temperature treatment, is used as a base material, the coated resin needs to be thermally treated (aged) at low temperature for a long time in order to give a sufficiently-cured coating film. This complicates the production processes, and further poses problems in that defects such as occurrence of cockles and blocking are often generated.

Patent Document 2 discloses, as a heat resistant slipping layer of a noncurable resin, a heat resistant slipping layer excellent in printing stability and traveling stability. The heat resistant slipping layer is formed from a resin composition which includes a binder containing a mixture of specific amounts of a polyamideimide resin and a polyamideimide silicone resin, a polyvalent metal salt of alkyl phosphate, and a filler.

These heat resistant slipping layers achieve improved productivity and slip property, but still have problems in that a defect called "tailing" is caused due to the heat resistant slipping layer when a high-print density portion, which needs a high energy application, is printed, followed by printing of an image including a low-print density portion. Here, the term "tailing" means a phenomenon in which a component of the heat resistant slipping layer that has been fused by a high energy applied during printing of the high-gray-scale portion is drawn with thermal energy being stored, and then causes problems in color development during printing of a low-print density portion. The occurrence of such tailing, mainly caused by the heat resistant slipping layer, becomes more marked as the thermal energy applied at the time of printing increases along with an increase in printing speed.

Meanwhile, Patent Document 3 discloses a thermal transfer ribbon including a polyester film, a colored ink material layer disposed on one surface of the polyester film, and a polyamide resin layer that is disposed on the other surface thereof and has specific physical properties and essentially contains an isophorone residue and a $C_{4-12}$ aliphatic dicarboxylic acid.

This polyamide resin layer can suppress the occurrence of tailing, but has poor friction stability to a high-gray-scale portion and insufficient heat-resistance because its slip property is improved only by copolymerization or modification of a polyfunctional silicone compound. Therefore, it has been required to develop thermal transfer sheets that have good heat resistance and slip property and can prevent the occurrence of tailing.

Patent Document 1: Japanese Kokai Publication Sho-61-14983

Patent Document 2: Japanese Kokai Publication 2001-334760

Patent Document 3: Japanese Kokai Publication Hei-7-314929

DISCLOSURE OF THE INVENTION

Problems to be Solved by the Invention

In view of the above-mentioned state of the art, it is an object of the present invention to provide a thermal transfer sheet that has good heat resistance and slip property and can prevent the occurrence of tailing upon printing to achieve good printing also in high-speed printing.

Means for Solving the Problems

The present invention relates to a thermal transfer sheet including: a base material; a color material layer provided on one surface of the base material; and a heat resistant slipping layer provided on the other surface of the base material, wherein the heat resistant slipping layer includes a polyamide resin, a silicone-modified polyamide resin, and an ethoxylated alcohol-modified wax.

It is preferable that a mixing ratio of the polyamide resin to the silicone-modified polyamide resin (polyamide resin/silicone-modified polyamide resin) is 1/5 to 10/1 by mass on a solid basis.

It is preferable that the ethoxylated alcohol-modified wax content in the heat resistant slipping layer is 3 to 50% by mass.

It is preferable that the heat resistant slipping layer further includes a linear polyethylene wax with a number average molecular weight of 1000 or larger.

It is preferable that the content of the linear polyethylene wax with a number average molecular weight of 1000 or larger in the heat resistant slipping layer is 1 to 50% by mass.

It is preferable that the heat resistant slipping layer further includes a metallic soap.

Hereinafter, the present invention will be described in detail.

The present invention relates to a thermal transfer sheet including a base material, a color material layer provided on one surface of the base material, and a heat resistant slipping layer provided on the other surface of the base material, wherein the heat resistant slipping layer contains a polyamide resin, a silicone-modified polyamide resin, and an ethoxylated alcohol-modified wax. The thermal transfer sheet of the present invention has good heat resistance and slip property and can prevent the occurrence of tailing upon printing to achieve good printing even in high-speed printing.

In the thermal transfer sheet of the present invention, the heat resistant slipping layer contains a polyamide resin and a silicone-modified polyamide resin. Therefore, the thermal transfer sheet can prevent tailing and have excellent slip property. Polyamide resins themselves are inferior in heat resistance to polyamideimide resins, which have been conventionally used for heat resistant slipping layers. In the present invention, the heat resistant slipping layer includes an ethoxylated alcohol-modified wax in addition to the polyamide resin and the silicone-modified polyamide resin, so that it can provide a thermal transfer sheet that has friction stability to high-gray-scale portion and simultaneously have excellent heat resistance.

Thus, the present invention was made by finding for the first time that a thermal transfer sheet can be provided with excellent slip property and heat resistance and can favorably prevent the occurrence of tailing caused due to a heat resistant slipping layer by forming a heat resistant slipping layer that contains a specific resin and a specific wax component.

The following will mention each of the layers constituting the thermal transfer sheet of the present invention in detail.

(Heat Resistant Slipping Layer)

The heat resistant slipping layer serves as a layer that prevents problems such as sticking and printing cockles caused due to traveling defects of a thermal head when the thermal transfer sheet of the present invention is subjected to thermal transfer.

In the thermal transfer sheet of the present invention, the heat resistant slipping layer contains, as a binder resin, a polyamide resin and a silicone-modified polyamide resin. The thermal transfer sheet of the present invention contains the polyamide resin and the silicone-modified polyamide resin in the heat resistant slipping layer, so that the occurrence of tailing also can be prevented, in addition to prevention of sticking, and printing cockles, attributed to the improved slip property.

The polyamide resin used in the present invention is not especially limited, and known polyamide resins may be used. For example, used may be polyamide resins that are produced by decarboxylation polycondensation of diisocyanate and aliphatic dicarboxylic acid or dehydration polycondensation of diamine and aliphatic dicarboxylic acid.

When the above polyamide resin is produced by reaction of diisocyanate and aliphatic dicarboxylic acid, isophorone diisocyanate and one or two or more selected from succinic acid, maleic acid, fumaric acid, glutaric acid, adipic acid, pimelic acid, suberic acid, azelaic acid, sebacic acid, nonanedicarboxylic acid, and decanedioic acid are essentially used. Further, when the above polyamide resin is produced by reaction of diamine and aliphatic dicarboxylic acid, isophorone diamine and one or two or more selected from succinic acid, maleic acid, fumaric acid, glutaric acid, adipic acid, pimelic acid, suberic acid, azelaic acid, sebacic acid, nonanedicarboxylic acid, and decanedioic acid are essentially used. Among these aliphatic dicarboxylic acids, adipic acid and/or azelaic acid is preferable in view of heat resistance, solubility, and cost.

The above polyamide resin may be copolymerized with other components unless heat resistance and solubility are deteriorated.

Examples of the above other components that can be used in the copolymerization include: diamine components, diisocyanate components, aliphatic dicarboxylic acids, and aromatic dicarboxylic acids, other than the above-mentioned ones.

Examples of the above diamine components and diisocyanate components, which are the above other components, include: 1,4-bis(4-aminophenoxy)benzene, 1,3-bis(4-aminophenoxy)benzene, 1,3-bis(3-aminophenoxy)benzene, 2,2-bis[4-(4-aminophenoxy)phenyl]propane, 2,2-bis[4-(4-aminophenoxy)phenyl]hexafluoropropane, bis[4-(4-aminophenoxy)phenyl]sulfone, bis[4-(3-aminophenoxy)phenyl]sulfone, bis[4-(2-aminophenoxy)phenyl]sulfone, 3,3'-diaminodiphenyl propane, 4,4'-diaminodiphenyl propane, m-phenylenediamine, p-phenylene diamine, oxydianiline, methylene diamine, hexafluoro isopropylidene diamine, 1,4-naphthalene diamine, 1,5-naphthalene diamine, 2,6-naphthalene diamine, 2,7-naphthalene diamine, 2,2'-bis(4-aminophenyl)propane, 2,2'-bis(4-aminophenyl)hexafluoropropane, 4,4'-diaminodiphenyl ether, 3,4-diaminobiphenyl, 4,4'-diaminobenzophenone, hexamethylenediamine, tetramethylenediamine, 5-amino-1(4-aminophenyl)-1,3,3'-trimethylindan, 3,4-diamino diphenyl ether, isopropylidene dianyline, 3,3'-diaminobenzophenone, 4,4'-diaminocyclohexyl, o-tolidine, 2,4-tolylenediamine, 2,6-tolylenediamine, 4,4'-[1,3-phenylenebis(1-methylethylidene)]bisaniline, 4,4'-[1,4-phenylenebis(1-methylethylidene)]bisaniline, 3,3'-[1,3-phenylenebis(1-methylethylidene)]bisaniline, 4,4'diamino diphenyl sulfide, 3,3'-diamino diphenyl sulfide, 6-amino-1(4-aminophenyl)-1,3,3-trimethylindan, and diisocyanates thereof.

Examples of the aliphatic dicarboxylic acids, which are the above other components, include oxalic acid, malonic acid, undecanedicarboxylic acid, dodecane dicarboxylic acid, tridecanedicarboxylic acid, and tetradecane dicarboxylic acid.

Examples of the aromatic dicarboxylic acids, which are the above other components, include isophthalic acid, terephthalic acid, 5-tertbutyl-1,3-benzenedicarboxylic acid, diphenylmethane-4, 4'-dicarboxylic acid, diphenylmethane-2,4' dicarboxylic acid, diphenylmethane-3,4'-dicarboxylic acid, diphenylmethane-3,3'-dicarboxylic acid, 1,2-diphenylethane-4,4'-dicarboxylic acid, 1,2-diphenylethane-2,4'-dicarboxylic acid, 1,2-diphenylethane-3,4'-dicarboxylic acid, 1,2-diphenylethane-3,3'-dicarboxylic acid, 2,2-bis(4-carboxyphenyl)propane, 2(2-carboxyphenyl)2(4-carboxyphenyl)propane, 2(3-carboxyphenyl)2(4-carboxyphenyl)propane, 2,2-bis(3 carboxyphenyl)propane, diphenyl ether-4,4'-dicarboxylic acid, diphenyl ether-2,4-dicarboxylic acid, diphenyl ether-3,4-dicarboxylic acid, diphenyl ether-3,3-dicarboxylic acid, diphenyl sulfide-4,4-dicarboxylic acid, diphenyl sulfide-2,4-dicarboxylic acid, diphenyl sulfide-3,4-dicarboxylic acid, diphenyl sulfide-3,3-dicarboxylic acid, diphenylsulfone-4,4-dicarboxylic acid, diphenylsulfone-2,4-dicarboxylic acid, diphenylsulfone-3,4-dicarboxylic acid, diphenylsulfone-3,3-dicarboxylic acid, benzophenone-3,4-dicarboxylic acid, benzophenone-3,3-dicarboxylic acid, 1,1,3-trimethyl-5-carboxy-3(p-carboxyphenyl)indan, and pyridine-2,6-dicarboxylic acid.

Among these other components that can be used in the copolymerization, terephthalic acid or isophthalic acid is preferable in view of reactivity and cost. When these terephthalic acid and/or isophthalic acid are used as a copolymerizable component, its amount is preferably 5 to 70 mole %, and more preferably 10 to 40 mole % in all the dicarboxylic acids in terms of heat resistance and solubility.

The polyamide resin used in the present invention may be further copolymerized with a tri- or higher functional amine compound, isocyanate compound, carboxylic acid, and acid anhydride.

Examples of the tri- or higher functional amine compound include diethylenetriamine, triethylenetriamine, and hexamethylenetetramine.

As the tri- or higher functional isocyanate compound, the followings are mentioned: a condensate of trimethylolpropane and tolylene diisocyanate, a cyclic trimer of isophorone diisocyanate or hexamethylene diisocyanate, initial condensates such as diphenylmethane diisocyanate and tolylene diisocyanate.

Examples of the above tri- or higher functional carboxylic acid and acid anhydride include trimellitic acid, pyromellitic acid, diphenylsulfone tetracarboxylic acid, diphenyl ether tetracarboxylic acid, biphenyl tetracarboxylic acid, and anhydrides thereof.

The above decarboxylation polycondensation and dehydration polycondensation may each be carried out by known procedures.

The above silicone-modified polyamide resin is a resin obtained by copolymerizing or modifying a polyamide resin with a polyfunctional silicone compound.

Examples of the above polyfunctional silicone compound include silicone compounds containing a hydroxyl group, a carboxyl group, an epoxy group, an amino group, or an acid anhydride group at the terminal or in the molecular chain.

The copolymerized or modified polyfunctional silicone compound content in the above silicone-modified polyamide resin is preferably 0.1 to 50% by mass, and more preferably 1 to 30% by mass. A content of less than 0.1% by mass may lead to insufficient exhibition of the effect attributed to the silicone copolymerization or modification. A content of more than 50% by mass is too large, which may cause a reduction in adhesion or insufficient heat resistance.

In the above heat resistant slipping layer, it is preferable that a mixing ratio of the polyamide resin to the silicone-modified polyamide resin (polyamide resin/silicone-modified polyamide resin) is 1/5 to 10/1 by mass on a solid basis. A mixing ratio of less than 1/5 may possibly lead to insufficient strength of a coating film, which results in reduction in heat resistance and adhesion. A mixing ratio of more than 10/1 may possibly lead to insufficient slip property of the heat resistant slipping layer, which results in occurrence of defects such as cockles and sticking. The mixing ratio is more preferably in the range of 1/3 to 8/1.

The above heat resistant slipping layer includes an ethoxylated alcohol-modified wax.

The heat resistant slipping layer contains the above ethoxylated alcohol-modified wax, and thus the heat resistance can be also improved in addition to improvement in slip property of the heat resistant slipping layer and prevention of the occurrence of tailing.

The above ethoxylated alcohol-modified wax may be, for example, a compound represented by the following formula (A).

$$R—O—(C_mH_{2m}O)_n—H \quad (A)$$

(in the formula, R is a $C_{10-100}$ alkyl group, preferably $C_{20-50}$ alkyl group; n is 2 to 100, preferably 10 to 50, particularly preferably 10 to 20; m is 2 to 3, preferably 2. The alkyl group may be a straight or branched alkyl group with a straight alkyl group being preferred.)

Commercially-available products of the above ethoxylated alcohol-modified wax, for example, include "UNITOX 750", "UNITOX 420", "UNITOX 490" (trade name, manufactured by Toyo Petrolite Co., Ltd.).

In the present invention, the above ethoxylated alcohol-modified wax is preferably used in combination with the above polyamide resin and silicone-modified polyamide resin. The ethoxylated alcohol-modified wax includes an alkyl group that can provide slip property, and an ethoxylated portion and an alcohol group each with a proper polarization, as shown in the above formula (A). On the other hand, the polyamide resin and the silicone-modified polyamide resin are each a more polar resin. Therefore, the above ethoxylated alcohol-modified wax has high affinity for the polyamide resin and silicone-modified polyamide resin that are more polar resins, and thus can exhibit good slip property.

It is preferable that the ethoxylated alcohol-modified wax content in the heat resistant slipping layer is 3 to 50% by mass. A content of less than 3% by mass is too small, and performances may not be exhibited, leading to a reduction in heat resistance and slip property under high temperatures. A content of more than 50% by mass leads to a reduction in strength of the heat resistant slipping layer, and the heat resistance may be deteriorated. The lower limit of the content is more preferably 5% by mass, and the upper limit thereof is more preferably 30% by mass.

It is preferable that the heat resistant slipping layer further includes a linear polyethylene wax with a number average molecular weight of 1000 or larger.

The heat resistant slipping layer contains a linear polyethylene wax with a number average molecular weight of 1000 or larger, in addition to the polyamide resin, the silicone-modified polyamide resin, and the ethoxylated alcohol-modified wax, so that the thermal transfer sheet can exhibit extremely excellent heat resistance. This is because of the following reasons.

Specifically, the linear polyethylene wax with a number average molecular weight of 1000 or larger has a melting point and a hardness that are higher than those of low-molecular linear polyethylene waxes or branched polyethylene waxes. Therefore, the above linear polyethylene wax with a number average molecular weight of 1000 or larger is included in the heat resistant slipping layer, and thereby the slip property and the heat resistance during application of a high energy can be improved. Meanwhile, the linear polyethylene wax with a number average molecular weight of 1000 or larger is a less polar compound, and therefore has low affinity for the above more polar polyamide resin or silicone-modified polyamide resin.

In the present invention, however, as mentioned above, the ethoxylated alcohol-modified wax containing a less polar alkyl group, a moderately-polarized ethoxylated portion and an alcohol group is included in the heat resistant slipping layer, so that also in the case where the linear polyethylene wax with a number average molecular weight of 1000 or larger is used, the affinity between the above polyamide resin or silicone-modified polyamide resin and the above linear polyethylene wax becomes better, and thus, the heat resistant slipping layer can be preferably provided with the above characteristics of the linear polyethylene wax. As a result, a thermal transfer sheet can exhibit extremely excellent heat resistance.

It is preferable that the linear polyethylene wax has a number average molecular weight of 1000 or larger. A number average molecular weight of less than 1000 may fail to improve the heat resistance any more. More preferably, the linear polyethylene wax has a number average molecular weight of 1000 to 3000. The above number average molecular weight is a value that can be determined by osmometry.

Commercially available products of the above linear polyethylene wax with a number average molecular weight of 1000 or larger include, for example, "POLYWAX 1000", "POLYWAX 2000", and "POLYWAX 3000" (trade name, products of Toyo Petrolite Co., Ltd.).

It is preferable that the linear polyethylene wax content in the heat resistant slipping layer is 1 to 50% by mass. A content of less than 1% by mass is too small, and a further improvement in heat resistance may not be achieved. A content of more than 50% by mass may lead to a reduction in strength of the heat resistant slipping layer, and the heat resistance may be deteriorated. The lower limit of the content is more preferably 1% by mass, and the upper limit thereof is more preferably 30% by mass.

It is preferable that the heat resistant slipping layer further includes a metallic soap.

The heat resistant slipping layer including the metallic soap becomes excellent in slip property and allows an improvement in traveling stability of the thermal transfer sheet. As a result of this, an excellent printed matter can be obtained.

Examples of the metallic soap include a polyvalent metal salt of an alkyl phosphate and a metal salt of an alkyl carboxylic acid.

The following compounds represented by the following formulae (1) and (2) are exemplified as the above polyvalent metal salt of an alkyl phosphate.

[Formula 1]

(1)

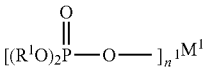

[Formula 2]

(2)

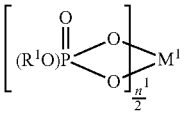

(in each formula, $R^1$ is a $C_{12}$ or higher alkyl group; $M^1$ represents an alkali earth metal, zinc, or aluminum; $n^1$ represents a valence of $M^1$).

The above $R^1$ is preferably a $C_{12-18}$ alkyl group. Examples of $R^1$ include cetyl, lauryl, and stearyl groups. A stearyl group is especially preferred in terms of cost and avoidance of contamination such as bleed-out.

Examples of the alkali earth metal represented as $M^1$ include barium, calcium, and magnesium.

The following compound represented by the formula (3) is mentioned as the above metal salt of an alkyl carboxylic acid.

[Formula 3]

(3)

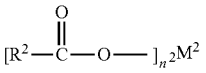

(in the formula, $R^2$ represents a $C_{11}$ or higher alkyl group; $M^2$ represents an alkali earth metal, zinc, aluminum, or lithium; $n^2$ represents a valence of $M^2$).

The above $R^2$ is preferably $C_{11-18}$ alkyl group. Examples of $R^2$ include dodecyl, hexadecyl, heptadecyl, and stearyl groups. In terms of ready availability, cost, and avoidance of contamination such as bleed-out, dodecyl, heptadecyl, and stearyl groups are preferable, and a stearyl group is more preferable.

Examples of the alkali earth metal represented by $M^2$ include barium, calcium, and magnesium.

The metallic soap is preferably a magnesium, zinc, or aluminum compound, and more preferably a zinc compound because slip property can be exhibited during application of a middle to high energy and in terms of heat resistance. The metallic soap is further preferably zinc stearate or zinc stearyl phosphate.

The metallic soap preferably has an average particle size of 3 to 20 μm, and more preferably 3 to 15 μm.

If the average particle size is too large, the metallic soap may be unevenly present in the heat resistant slipping layer, and as a result, the slip property becomes locally insufficient, and a foreign matter may be deposited on the thermal head. If the average particle size is too small, the heat resistant slipping layer may have insufficient slip property, and this may cause a problem such as printing cockles. The above-mentioned average particle size is a value determined by laser diffractometry.

The metallic soap content is preferably 1 to 50 parts by mass relative to 100 parts by mass of the binder resin. A content of less than 1 part by mass may be insufficient for desired performances to be exhibited, and thus fusion may be caused due to insufficient slip property and releasability property from a thermal head upon heat application. A content of more than 50 parts by mass may cause a reduction in strength of the heat resistant slipping layer. The content is more preferably 2 to 30 parts by mass.

The heat resistant slipping layer may further contains a filler.

When the heat resistant slipping layer contains the above filler, cleaning ability for foreign matters deposited on the thermal head, the slip property and the anti-blocking ability can be adjusted preferably.

Examples of the above filler include talc, kaolin, mica, graphite, calcium carbonate, molybdenum disulfide, silicone rubber filler, benzoguanamine resin, and melamine-formaldehyde condensate. Among them, talc, silicone rubber filler and calcium carbonate are preferable, and talc is more preferable.

The filler content is preferably 1 to 30 parts by mass relative to 100 parts by mass of the binder resin. An content of less than 1 part by mass may lead to a failure of exhibition of cleaning ability. An content of more than 30 parts by mass may lead to deterioration in flexibility and strength of the heat resistant slipping layer. The filler content is more preferably 1 to 20 parts by mass.

The heat resistant slipping layer optionally includes other components in addition to the above components. Examples of the above other components include thermal release agents or lubricants such as waxes other than the above ethoxylated alcohol-modified wax and linear polyethylene wax with a number average molecular weight of 1000 or larger, higher fatty acid amides, surfactants, silicone oils, and other resins. Known compounds of these may be used.

The above heat resistant slipping layer is formed by dissolving or dispersing the above polyamide resin, the above silicone-modified polyamide resin, the above ethoxylated alcohol-modified wax, and optionally used other components mentioned above, such as the linear polyethylene wax with a number average molecular weight of 1000 or larger and metallic soap in a solvent to prepare a coating liquid for heat resistant slipping layer, and then applying the resulting coating liquid by a common coating means such as a gravure coater, a roll coater, and a wire bar, and then drying the applied coating liquid.

The above solvent is preferably a solvent capable of dissolving a binder resin therein because an excellent coating film can be formed. In the present invention, for example, the polyamide resin, which is a binder resin, is a more polar resin, and therefore the solvent is preferably a more polar solvent. Particularly, the solvent is preferably an alcohol with a low boiling point because of excellent workability and low cost. Examples of the alcohol, but not limited to, include the following alcohols with a relatively low boiling point and high volatility: methyl alcohol, ethyl alcohol, n-propyl alcohol, isopropyl alcohol, n-butyl alcohol, sec-butyl alcohol, and tert-butyl alcohol.

As the above solvent, an alcohol, part of which has been substituted with another solvent, may be used. Examples of the another solvent include: amide solvents such as N-methyl-2-pyrrolidone, dimethylacetamide, and dimethylformamide; sulfur solvents such as dimethylsulfooxide and sulfolan; nitro solvents such as nitromethane and nitroethane; ether solvents such as diglyme and tetrahydrofuran; ketone solvents such as cyclohexanone and methyl ethyl ketone; nitrile solvents such as acetonitrile and propionitrile; and aromatic hydrocarbon solvents such as toluene, xylene, and benzene. Further, water also may be used.

The above heat resistant slipping layer can exhibit desired performances of the present invention when coated generally in an amount of 2.0 $g/m^2$ or less on a dry solid basis.

The amount of the heat resistant slipping layer to be coated is preferably 0.1 to 1.5 $g/m^2$, and more preferably 0.2 to 1.0 $g/m^2$ on a dry solid basis.

The heat resistant slipping layer may not exhibit its functions adequately if its thickness is too small; whereas it may show deteriorated sensitivity at the time of printing if its thickness is too large.

(Base Material)

The thermal transfer sheet of the present invention includes the above heat resistant slipping layer provided on one surface of the base material.

As the above base material, any of known products whose heat resistance and strength are at a certain level may be used. Examples thereof include resin films of, e.g., polyethylene terephthalate, 1,4-polycyclohexylene dimethylene terephthalate, polyethylenenaphthalate, polyphenylene sulfide, polystyrene, polypropylene, polysulfone, aramid, polycarbonate, polyvinyl alcohol, cellophane, cellulose derivative such as cellulose acetate, polyethylene, polyvinylchloride, nylon, polyimide, or ionomer; papers such as a condenser paper, a paraffin paper, and a synthetic paper; nonwoven fabrics; complexes of a resin and a paper or a nonwoven fabric.

The above base material generally has a thickness of about 0.5 to 50 μm, and preferably about 1.5 to 10 μm.

The above base material may be subjected to surface treatment in order to improve the adhesiveness to an adjacent layer. As the surface treatment, known techniques for modifying the resin surface can be applied, such as corona discharge treatment, flame treatment, ozone treatment, ultraviolet treatment, radiation treatment, surface roughening treatment, chemical treatment, plasma treatment, and grafting treatment. The above surface treatment may be used singly or in combination of two or more of them.

In the present invention, among the above surface treatments, corona treatment and plasma treatment are preferred because of low cost. Further, an under coat layer (primer layer) may be optionally formed on one or both surfaces of the base material.

(Color Material Layer)

The thermal transfer sheet of the present invention includes a color material layer on one surface of the base material. Specifically, the thermal transfer sheet includes a color material layer on the surface of the base material that is opposite to the surface where the above heat resistant slipping layer is provided.

When desired images are in monochrome, the thermal transfer sheet of the present invention may include only a layer of single color appropriately selected as the color material layer. When desired images are in full color, it may include layers of cyan, magenta and yellow (and optionally a layer of black) as the color material layer.

When the thermal transfer sheet of the present invention is a sublimation dye thermal transfer sheet, a layer containing a sublimation dye is formed as the color material layer. When it is a thermofusible thermal transfer sheet, a thermofusible ink layer colored with a pigment is formed as the color material layer.

Hereinafter, the present invention will be described, taking a sublimation dye thermal transfer sheet as an example, but is not limited only thereto.

Sublimation dyes used in the sublimation dye layer are not especially limited, and known dyes may be used.

Examples of the above sublimation dyes include diaryl methane dyes; triaryl methane dyes; thiazole dyes; merocyanine dyes; pyrazolone dyes; methyne dyes; indoaniline dyes; azomethine dyes such as acetophenoneazomethine, pyrazoloazomethine, imidazoleazomethine, imidazoazomethine, and pyridoneazomethine; xanthene dyes; oxazine dyes; cyanostyrene dyes such as dicyanostyrene and tricyanostyrene; thiazine dyes; azine dyes; acridine dyes; benzeneazo dyes; azo dyes such as pyridoneazo, thiopheneazo, isothiazoleazo, pyrroleazo, pyrazoleazo, imidazoleazo, thiadiazoleazo, triazoleazo and disazo; spiropyran dyes; indolinospiropyran dyes; fluoran dyes; rhodaminelactam dyes; naphthoquinone dyes; anthraquinone dyes; and quinophthalone dyes. More specific examples thereof include a compound exemplified in Japanese Kokai Publication Hei-7-149062.

In the dye layer, the amount of the sublimation dye is 5 to 90% by mass, and preferably 10 to 70% by mass with respect to the total solid content of the dye layer.

If the amount of the sublimation dye to be used is less than the above range, a print density may become low. If it is more than the above range, a preserving property may be deteriorated.

As a binder resin to support the dye, generally, a resin that has heat resistance and moderate affinity for the dye can be used.

Examples of the above binder resin include cellulosic resins such as ethylcellulose, hydroxyethylcellulose, ethylhydroxycellose, hydroxypropylcellulose, methylcellulose, cellulose acetate, and cellulose butyrate; vinyl resins such as polyvinyl alcohol, polyvinyl acetate, polyvinyl butyral, polyvinylacetoacetal, and polyvinylpyrrolidone; acrylic resins such as poly(meth)acrylate and poly(meta)acrylamide; polyurethane resins; polyamide resins; and polyester resins.

As the binder resin, among them, cellulosic resins, vinyl resins, acrylic resins, urethane resins, and polyester resins are preferable; vinyl resins are more preferable; and polyvinyl butyral and polyvinylacetoacetal still more preferable from the viewpoints of heat resistance and dye transfer.

Additives such as a mold release agent, inorganic particles, and organic particles may be used as desired for the above dye layer.

Examples of the mold release agent include silicone oils and phosphate esters.

Examples of the inorganic particles include carbon black, aluminum, and molybdenum disulfide.

Examples of the organic particles include polyethylene wax.

The dye layer can be formed by dissolving or dispersing the above dye and the above binder together with the optionally used additives in a proper organic solvent or water to prepare a coating liquid and then applying the coating liquid onto one surface of the above base material by known means such as gravure printing, screen printing, and reverse roll coating printing which uses a gravure plate, and then drying the applied coating liquid.

Examples of the organic solvent include toluene, methyl ethyl ketone, ethanol, isopropyl alcohol, cyclohexanone, and dimethylformamide [DME].

The amount of the above dye layer to be coated is 0.2 to 6.0 $g/m^2$, and preferably about 0.2 to 3.0 $g/m^2$ on a dry solid basis.

(Others)

The thermal transfer sheet of the present invention may be provided with another layer such a protective layer including an adhesive layer, a peeling layer and a release layer; or an under coat layer as long as it includes the base material, the color material layer provided on one surface of the base material, and the heat resistant slipping layer provided on the other surface of the base material.

When the above protective layer is formed on the above color material layer in a surface sequential manner, a protective layer that protects an image surface can be transferred after image printing.

The constitution and the preparation of the protective layer are not particularly limited, and they can be selected from known techniques in accordance with features of a base material sheet or a color material layer to be used.

The above under coat layer is not particularly limited, and it can be provided by appropriately selecting the composition which allows improvements in adhesiveness between the base material and the color material layer and in dye transfer efficiency.

(Printing)

The thermal transfer sheet of the present invention can print images in such a manner that a thermal head applies heat and pressure to a prescribed printing portion from the heat resistant slipping layer-side of the base material, and whereby a color material is transferred to a transfer image-receiving material.

When the thermal transfer sheet of the present invention is a thermal sublimation transfer sheet, a thermal transfer image-receiving sheet may be used as the above transfer image-receiving material.

The above thermal transfer image-receiving sheet is not particularly limited as long as its recording face has a dye-receiving property, and examples thereof include a sheet constituted by a base material made of paper, metal, glass or synthetic resin and a dye-receiving layer provided on at least one surface of the base material. The above thermal transfer image-receiving sheet may not include a receiving layer when the base material itself has dye-receiving property.

When the thermal transfer sheet is a thermofusible transfer sheet, a common paper or plastic film may be also used as the transfer image-receiving material.

The printer used for the above thermal transfer is not particularly limited, and known thermal transfer printers may be used.

Effect of the Invention

Since the thermal transfer sheet of the present invention has the above constitution, it has good heat resistance and slip property, and can prevent tailing upon high-speed printing to achieve good printing. Therefore, the thermal transfer sheet of the present invention can be used preferably as a thermal transfer sheet for high-speed printing.

Best Mode for Carrying Out the Invention

Hereinafter, the present invention will be described in more detail by way of examples. The terms "part" and "%" used herein mean "part by mass" and "% by mass" unless otherwise specified.

PRODUCTION EXAMPLE 1

Production of Polyamide Resin

Decanedioic acid 1 mole, isophorone diisocyanate 1 mole, and sodium methoxide 0.02 mole were charged together with γ-butyrolactone into a reaction vessel to prepare a solution with a monomer concentration of 50% by mass. A reaction was allowed to proceed in this solution under stirring at 100° C. for 2 hours, followed by further reaction at 180° C. for 3 hours. The resulting solution was cooled to room temperature while being diluted with N-methyl-2-pyrrolidone to about 20%, and then poured into water to precipitate a polymer. The polymer was filtered to give a polyamide resin.

PRODUCTION EXAMPLE 2

Production of Silicone-Modified Polyamide Resin

Decanedioic acid 1 mole, isophorone diisocyanate 1 mole, sodium methoxide 0.02 mole, and BYK 370 (product of BYK-CHEMIE, hydroxyl group-containing polyester-modified dimethyl polysiloxane: 25%), which were in an amount of 1% by mass in total, were charged together with γ-butyrolactone into a reaction vessel to prepare a solution with a monomer concentration of 50% by mass. A reaction was allowed to proceed in this solution under stirring at 100° C. for 2 hours, followed by further reaction at 180° C. for 3 hours. The resulting solution was cooled to room temperature while being diluted with N-methyl-2-pyrrolidone to about 20%, and then poured into water to precipitate a polymer. The polymer was filtered to give a silicone-modified polyamide resin.

EXAMPLE 1

(Formation of Color Material Layer)

A 4.5 μm-thick polyethylene terephthalate (PET) film was used as a base material sheet, and on one surface thereof, a coating liquid for color material layer having the following composition was gravure-coated in an amount on a dry basis of 0.7 $g/m^2$, and then dried to form a color material layer.

| <Coating liquid for color material layer> | |
|---|---|
| C.I. solvent blue 63 | 6.0 parts |
| Polyvinyl butyral resin (S-LEC BX-1, product of SEKISUI CHEMICAL Co., Ltd.) | 3.0 parts |
| Methyl ethyl ketone | 45.5 parts |
| Toluene | 45.5 parts |

(Formation of Heat Resistant Slipping Layer)

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. The resulting coating liquid for heat resistant slipping layer was gravure-coated in an amount on a dry basis of 0.4 g/m$^2$ on the surface of the film that is opposite to the surface on which the color material layer has been formed, and the resultant coating was dried to form a heat resistant slipping layer. Thus, a thermal transfer sheet was produced. The numeral values are on a solid content basis.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 750, product of Toyo Petrolite Co., Ltd.) | 20.0 parts |

EXAMPLE 2

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 67.5 parts |
| Silicone-modified polyamide resin produced in production example 2 | 22.5 parts |
| Ethoxylated alcohol-modified wax (trade name UNITOX 750, product of Toyo Petrolite Co., Ltd.) | 10.0 parts |

EXAMPLE 3

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 71.25 parts |
| Silicone-modified polyamide resin produced in production example 2 | 23.75 parts |

-continued

| | |
|---|---|
| Ethoxylated alcohol-modified wax (trade name UNITOX 750, product of Toyo Petrolite Co., Ltd.) | 5.0 parts |

EXAMPLE 4

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 72.75 parts |
| Silicone-modified polyamide resin produced in production example 2 | 24.25 parts |
| Ethoxylated alcohol-modified wax (trade name UNITOX 750, product of Toyo Petrolite Co., Ltd.) | 3.0 parts |

EXAMPLE 5

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 74.25 parts |
| Silicone-modified polyamide resin produced in production example 2 | 24.75 parts |
| Ethoxylated alcohol-modified wax (trade name UNITOX 750, product of Toyo Petrolite Co., Ltd.) | 1.0 parts |

EXAMPLE 6

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 37.5 parts |
| Silicone-modified polyamide resin produced in production example 2 | 12.5 parts |
| Ethoxylated alcohol-modified wax (trade name UNITOX 750, product of Toyo Petrolite Co., Ltd.) | 50.0 parts |

EXAMPLE 7

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 18.75 parts |
| Silicone-modified polyamide resin produced in production example 2 | 6.25 parts |
| Ethoxylated alcohol-modified wax (trade name UNITOX 750, product of Toyo Petrolite Co., Ltd.) | 75.0 parts |

EXAMPLE 8

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 72.0 parts |
| Silicone-modified polyamide resin produced in production example 2 | 8.0 parts |
| Ethoxylated alcohol-modified wax (trade name UNITOX 750, product of Toyo Petrolite Co., Ltd.) | 20.0 parts |

EXAMPLE 9

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 76.0 parts |
| Silicone-modified polyamide resin produced in production example 2 | 4.0 parts |
| Ethoxylated alcohol-modified wax (trade name UNITOX 750, product of Toyo Petrolite Co., Ltd.) | 20.0 parts |

EXAMPLE 10

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 40.0 parts |
| Silicone-modified polyamide resin produced in production example 2 | 40.0 parts |
| Ethoxylated alcohol-modified wax (trade name UNITOX 750, product of Toyo Petrolite Co., Ltd.) | 20.0 parts |

EXAMPLE 11

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 16.0 parts |
| Silicone-modified polyamide resin produced in production example 2 | 64.0 parts |
| Ethoxylated alcohol-modified wax (trade name UNITOX 750, product of Toyo Petrolite Co., Ltd.) | 20.0 parts |

EXAMPLE 12

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 8.0 parts |
| Silicone-modified polyamide resin produced in production example 2 | 72.0 parts |
| Ethoxylated alcohol-modified wax (trade name UNITOX 750, product of Toyo Petrolite Co., Ltd.) | 20.0 parts |

EXAMPLE 13

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 750, product of Toyo Petrolite Co., Ltd.) | 10.0 parts |
| Metallic soap (zinc stearate, trade name SZ-PF, product of Sakai Chemical Industry Co., Ltd.) | 10.0 parts |

EXAMPLE 14

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 420, product of Toyo Petrolite Co., Ltd.) | 20.0 parts |

EXAMPLE 15

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 490, product of Toyo Petrolite Co., Ltd.) | 20.0 parts |

EXAMPLE 16

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 750, product of Toyo Petrolite Co., Ltd.) | 10.0 parts |
| Linear polyethylene wax (trade name POLYWAX 3000, number average molecular weight: 3000, product of Toyo Petrolite Co., Ltd.) | 10.0 parts |

EXAMPLE 17

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 750, product of Toyo Petrolite Co., Ltd.) | 10.0 parts |
| Linear polyethylene wax (trade name POLYWAX 2000, number average molecular weight: 2000, product of Toyo Petrolite Co., Ltd.) | 10.0 parts |

EXAMPLE 18

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 750, product of Toyo Petrolite Co., Ltd.) | 10.0 parts |
| Linear polyethylene wax (trade name POLYWAX 1000, number average molecular weight: 1000, product of Toyo Petrolite Co., Ltd.) | 10.0 parts |

EXAMPLE 19

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 750, product of Toyo Petrolite Co., Ltd.) | 10.0 parts |
| Linear polyethylene wax (trade name POLYWAX 850, number average molecular weight: 850, product of Toyo Petrolite Co., Ltd.) | 10.0 parts |

EXAMPLE 20

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 60.0 parts |
| Silicone-modified polyamide resin produced in production example 2 | 20.0 parts |
| Ethoxylated alcohol-modified wax (trade name UNITOX 750, product of Toyo Petrolite Co., Ltd.) | 10.0 parts |
| Branched polyethylene wax (trade name PETROLITE EP-1100, number average molecular weight 1100, product of Toyo Petrolite Co., Ltd.) | 10.0 parts |

EXAMPLE 21

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 65.0 parts |
| Silicone-modified polyamide resin produced in production example 2 | 25.0 parts |
| Ethoxylated alcohol-modified wax (trade name UNITOX 750, product of Toyo Petrolite Co., Ltd.) | 10.0 parts |

EXAMPLE 22

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 64.5 parts |
| Silicone-modified polyamide resin produced in production example 2 | 24.5 parts |
| Ethoxylated alcohol-modified wax (trade name UNITOX 750, product of Toyo Petrolite Co., Ltd.) | 10.0 parts |
| Linear polyethylene wax (trade name POLYWAX 3000, number average molecular weight: 3000, product of Toyo Petrolite Co., Ltd.) | 1.0 part |

EXAMPLE 23

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 62.5 parts |
| Silicone-modified polyamide resin produced in production example 2 | 22.5 parts |
| Ethoxylated alcohol-modified wax (trade name UNITOX 750, product of Toyo Petrolite Co., Ltd.) | 10.0 parts |
| Linear polyethylene wax (trade name POLYWAX 3000, number average molecular weight: 3000, product of Toyo Petrolite Co., Ltd.) | 5.0 parts |

EXAMPLE 24

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 30.0 parts |
| Silicone-modified polyamide resin produced in production example 2 | 10.0 parts |
| Ethoxylated alcohol-modified wax (trade name UNITOX 750, product of Toyo Petrolite Co., Ltd.) | 10.0 parts |
| Linear polyethylene wax (trade name POLYWAX 3000, number average molecular weight: 3000, product of Toyo Petrolite Co., Ltd.) | 50.0 parts |

EXAMPLE 25

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. A thermal transfer sheet was produced in the same manner as in example 1, except that this coating liquid for heat resistant slipping layer was used.

| | |
|---|---|
| Polyamide resin produced in production example 1 | 22.5 parts |
| Silicone-modified polyamide resin produced in production example 2 | 7.5 parts |
| Ethoxylated alcohol-modified wax (trade name UNITOX 750, product of Toyo Petrolite Co., Ltd.) | 10.0 parts |
| Linear polyethylene wax (trade name POLYWAX 3000, number average molecular weight: 3000, product of Toyo Petrolite Co., Ltd.) | 60.0 parts |

COMPARATIVE EXAMPLE 1

Materials were mixed in accordance with the following composition, and the resulting mixture was adjusted to have a solid content of 20% with a 1:1 mixture of toluene and ethanol. Then, the mixture was stirred and dispersed in a paint shaker for 1 hour to prepare a coating liquid for heat resistant slipping layer. Except for this, a heat resistant slipping layer was formed and then a thermal transfer sheet was produced in the same manners as in example 1.

| | |
|---|---|
| Polyamideimide resin (trade name: HR-15ET, product of TOYOBO Co., Ltd.) | 60.0 parts |
| Polyamideimide silicone resin (trade name: HR-14ET, product of TOYOBO Co., Ltd.) | 20.0 parts |
| Ethoxylated alcohol-modified wax (trade name UNITOX 750, product of Toyo Petrolite Co., Ltd.) | 20.0 parts |

COMPARATIVE EXAMPLE 2

Materials were mixed in accordance with the following composition, and the resulting mixture was adjusted to have a solid content of 20% with a 1:1 mixture of toluene and methyl ethyl ketone. Then, the mixture was stirred and dispersed in a paint shaker for 1 hour to prepare a coating liquid for heat resistant slipping layer. Except for this, a heat resistant slipping layer was formed and then a thermal transfer sheet was produced in the same manners as in example 1.

| | |
|---|---|
| Butyral resin (trade name S-LEC BX-1, product of Sekisui Chemical Co., Ltd.) | 60.0 parts |
| Silicone-modified butyral resin (trade name DAI-ALLOMER SP-712, product Dainichiseika Colour & Chemicals Mfg. Co., Ltd.) | 20.0 parts |
| Ethoxylated alcohol-modified wax (trade name UNITOX 750, product of Toyo Petrolite Co., Ltd.) | 20.0 parts |

COMPARATIVE EXAMPLE 3

Materials were mixed in accordance with the following composition, and the resulting mixture was adjusted to have a solid content of 20% with a 1:1 mixture of toluene and methyl ethyl ketone. Then, the mixture was stirred and dispersed in a paint shaker for 1 hour to prepare a coating liquid for heat resistant slipping layer. Except for this, a heat resistant slipping layer was formed and then a thermal transfer sheet was produced in the same manners as in example 1.

| | |
|---|---|
| Acrylic resin (trade name DIANAL BR-85, product of Mitsubishi Rayon Co., Ltd.) | 60.0 parts |
| Silicone-modified acrylic resin (trade name Symac US-270, product of TOAGOSEI Co., Ltd.) | 20.0 parts |
| Ethoxylated alcohol-modified wax (trade name UNITOX 750, product of Toyo Petrolite Co., Ltd.) | 20.0 parts |

COMPARATIVE EXAMPLE 4

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. Except that this coating liquid for heat resistant slipping layer was used, a thermal transfer sheet was produced in the same manners as in example 1.

| | |
|---|---|
| Polyamide resin produced in production example 1 | 60.0 parts |
| Silicone-modified polyamide resin produced in production example 2 | 20.0 parts |
| Low-molecular weight polyethylene (trade name, POLYWAX 400, product of Toyo Petrolite Co., Ltd.) | 20.0 parts |

COMPARATIVE EXAMPLE 5

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. Except that this coating liquid for heat resistant slipping layer was used, a thermal transfer sheet was produced in the same manners as in example 1.

| | |
|---|---|
| Polyamide resin produced in production example 1 | 60.0 parts |
| Silicone-modified polyamide resin produced in production example 2 | 20.0 parts |
| Fatty acid (stearic acid, product of Nippon Fine Chemical Co., Ltd.) | 20.0 parts |

COMPARATIVE EXAMPLE 6

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. Except that this coating liquid for heat resistant slipping layer was used, a thermal transfer sheet was produced in the same manners as in example 1.

| | |
|---|---|
| Polyamide resin produced in production example 1 | 60.0 parts |
| Silicone-modified polyamide resin produced in production example 2 | 20.0 parts |
| Fatty amide (stearamide) (trade name FATTY AMIDE S, product of Kao Corp.) | 20.0 parts |

COMPARATIVE EXAMPLE 7

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. Except that this coating liquid for heat resistant slipping layer was used, a thermal transfer sheet was produced in the same manners as in example 1.

| | |
|---|---|
| Polyamide resin produced in production example 1 | 60.0 parts |
| Silicone-modified polyamide resin produced in production example 2 | 20.0 parts |
| Fatty amide (oleamide) (trade name FATTY AMIDE O—N, product of Kao Corp.) | 20.0 parts |

COMPARATIVE EXAMPLE 8

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. Except that this coating liquid for heat resistant slipping layer was used, a thermal transfer sheet was produced in the same manners as in example 1.

| | |
|---|---|
| Polyamide resin produced in production example 1 | 60.0 parts |
| Silicone-modified polyamide resin produced in production example 2 | 20.0 parts |
| Metallic soap (zinc stearate) (trade name SZ-PF, product of Sakai Chemical Industry Co., Ltd.) | 20.0 parts |

COMPARATIVE EXAMPLE 9

Materials were mixed in accordance with the following composition, and the resulting mixture was adjusted to have a solid content of 20% with a 1:1 mixture of methanol and ethanol. Then, the mixture was stirred and dispersed in a paint shaker for 1 hour to prepare a coating liquid for heat resistant slipping layer. Except that this coating liquid for heat resistant slipping layer was used, a thermal transfer sheet was produced in the same manners as in example 1.

| | |
|---|---|
| Polyamide resin produced in production example 1 | 60.0 parts |
| Silicone-modified polyamide resin produced in production example 2 | 20.0 parts |
| Fatty acid ester (stearyl stearate) (trade name EXCEPARL SS, product of Kao Corp.) | 20.0 parts |

The respective thermal transfer sheets in the above examples 1 to 15 and comparative examples 1 to 9 were evaluated in the following manner. Table 1 shows the results.

(Heat Resistance and Slip Property)

Each of the above thermal transfer sheets was combined with a thermal transfer image-receiving sheet for sublimation printer CP9000D manufactured by Mitsubishi Electric Corp. to be determined for dynamic friction coefficient upon printing under the following conditions. Then, the respective sheets were evaluated as follows. For printing and determination of dynamic friction coefficient, a thermal transfer printer with friction force measurement function, disclosed in JP-A 2003-300388, was used.

Thermal head: thermal head manufactured by Toshiba Hokuto electronics corp., head resistance: 6549Ω

Line speed: 1 ms/Line

Pulse duty: 90%

Applied voltage: 29.00 V

Printing pressure: 40 N

<Maximum Gray-Scale Value>

Under the above conditions, solid patterns of gray-scale values different by 5 were printed on the respective sheets. The energy that was one-level lower than the energy where defects such as cockles, sticking, and scrape of the heat resistant slipping layer occurred was defined as a maximum gray-scale value, and the respective sheets were evaluated for printing performances under the following criteria.

Good: Maximum gray-scale value of 255

Average: Maximum gray-scale value of 230 or higher and 254 or lower

Bad: Maximum gray-scale value of 229 or lower

Here, in the gray-scale value of printing data, 255 gray-scale corresponds to 100% solid image, and a ratio of the gray-scale value at the time of printing to 255, expressed as a percentage, corresponds to an applied energy of the printed pattern relative to the maximum applied energy (for example, in the case of 210 gray-scale value, 210/255=0.823, namely, 82% solid). Accordingly, it can be said that the sheet with a higher maximum gray-scale value is more endurable to a higher applied energy. Table 1 shows the results.

<Friction Force>

A solid pattern of the above maximum gray-scale value and a solid pattern of 128/255 gray-scale value (gray) were printed on the respective sheets. Sheets with a dynamic friction force of lower than 0.4 were evaluated as "excellent"; those with a dynamic friction force of 0.4 or higher and lower than 0.5 as "good"; and those with a dynamic friction force of 0.5 or higher as "average".

Here, in Table 1, "high-density portion" represents a portion where a solid pattern of the maximum gray-scale value was printed; and "middle-density portion" represents a portion where a solid pattern of 128/255 gray-scale value was printed.

(Tailing)

On each of the above thermal transfer sheets, a solid pattern and a half-gray pattern were each continuously printed with sublimation printer CP9550D manufactured by Mitsubishi Electric Corp. Then, existence of printing defects due to tailing was visually observed, and the sheets were evaluated in accordance with the following criteria.

Good: No tailing existed

Bad: Tailing existed

TABLE 1

| | Heat resistance (Maximum gray-scale value) | Friction force (Middle-density portion) | Friction force (High-density portion) | Tailing |
|---|---|---|---|---|
| Example 1 | Good | Good | Good | Good |
| Example 2 | Good | Good | Good | Good |
| Example 3 | Good | Good | Good | Good |
| Example 4 | Good | Good | Good | Good |
| Example 5 | Average | Good | Average | Good |
| Example 6 | Good | Good | Good | Good |
| Example 7 | Average | Good | Good | Good |
| Example 8 | Good | Good | Good | Good |
| Example 9 | Good | Average | Good | Good |
| Example 10 | Good | Good | Good | Good |
| Example 11 | Good | Good | Good | Good |
| Example 12 | Average | Good | Good | Good |
| Example 13 | Good | Excellent | Excellent | Good |
| Example 14 | Good | Good | Good | Good |
| Example 15 | Good | Good | Good | Good |
| Comparative Example 1 | Good | Good | Good | Bad |
| Comparative Example 2 | Bad | Good | Good | Good |
| Comparative Example 3 | Bad | Good | Good | Good |
| Comparative Example 4 | Bad | Good | Average | Good |
| Comparative Example 5 | Bad | Good | Average | Good |
| Comparative Example 6 | Bad | Good | Average | Good |
| Comparative Example 7 | Bad | Good | Good | Good |
| Comparative Example 8 | Bad | Excellent | Excellent | Good |
| Comparative Example 9 | Bad | Good | Average | Good |

Table 1 indicates that the thermal transfer sheets of the present invention were excellent in heat resistance and slip property, and free from tailing.

Also for the thermal transfer sheets of examples 16 to 25, the maximum gray-scale value and the friction force were determined, and the heat resistance and the slip property were evaluated, and the tailing was also evaluated in the same manners as mentioned above, except that the applied voltage was changed from "29.00 V" to "31.00 V". Table 2 shows the results.

TABLE 2

| | Heat resistance (Maximum gray-scale value) | Friction force (Middle-density portion) | Friction force (High-density portion) | Tailing |
|---|---|---|---|---|
| Example 16 | Good | Good | Good | Good |
| Example 17 | Good | Good | Good | Good |
| Example 18 | Good | Good | Good | Good |
| Example 19 | Average | Good | Average | Good |
| Example 20 | Average | Good | Average | Good |
| Example 21 | Average | Good | Average | Good |
| Example 22 | Good | Good | Good | Good |
| Example 23 | Good | Good | Good | Good |
| Example 24 | Good | Good | Good | Good |
| Example 25 | Bad | Good | Good | Good |

Table 2 indicates that thermal transfer sheets that are excellent in terms of heat resistance, slip property, and tailing could be obtained even under more severe measurement conditions where the applied voltage was higher, when the heat resistant slipping layer included the specific linear polyethylene wax in a specific amount as well as the ethoxylated alcohol-modified wax. The thermal transfer sheet in example 25 was evaluated as "bad" for heat resistance, but in the case where it was evaluated for heat resistance in the similar manner under 29.00 V applied voltage, the result was "average".

INDUSTRIAL APPLICABILITY

The thermal transfer sheet of the present invention can be used preferably as a thermal transfer sheet for high-speed printing.

The invention claimed is:

1. A thermal transfer sheet comprising:

a base material;

a color material layer provided on one surface of the base material; and a heat resistant slipping layer provided on the other surface of the base material, wherein the heat resistant slipping layer comprises a polyamide resin, a silicone-modified polyamide resin, and an ethoxylated alcohol-modified wax.

2. The thermal transfer sheet according to claim 1, wherein a mixing ratio of the polyamide resin to the silicone-modified polyamide resin (polyamide resin/silicone-modified polyamide resin) is 1/5 to 10/1 by mass on a solid basis.

3. The thermal transfer sheet according to claim 2, wherein the ethoxylated alcohol-modified wax content in the heat resistant slipping layer is 3 to 50% by mass.

4. The thermal transfer sheet according to claim 3, wherein the heat resistant slipping layer further comprises a linear polyethylene wax with a number average molecular weight of 1000 or larger.

5. The thermal transfer sheet according to claim 4, wherein the content of the linear polyethylene wax with a number average molecular weight of 1000 or larger in the heat resistant slipping layer is 1 to 50% by mass.

6. The thermal transfer sheet according to claim 3, wherein the heat resistant slipping layer further comprises a metallic soap.

7. The thermal transfer sheet according to claim 2, wherein the heat resistant slipping layer further comprises a linear polyethylene wax with a number average molecular weight of 1000 or larger.

8. The thermal transfer sheet according to claim 7, wherein the content of the linear polyethylene wax with a number average molecular weight of 1000 or larger in the heat resistant slipping layer is 1 to 50% by mass.

9. The thermal transfer sheet according to claim 7, wherein the heat resistant slipping layer further comprises a metallic soap.

10. The thermal transfer sheet according to claim 2, wherein the heat resistant slipping layer further comprises a metallic soap.

11. The thermal transfer sheet according to claim 1, wherein the ethoxylated alcohol-modified wax content in the heat resistant slipping layer is 3 to 50% by mass.

12. The thermal transfer sheet according to claim 11, wherein the heat resistant slipping layer further comprises a linear polyethylene wax with a number average molecular weight of 1000 or larger.

13. The thermal transfer sheet according to claim 12, wherein the content of the linear polyethylene wax with a number average molecular weight of 1000 or larger in the heat resistant slipping layer is 1 to 50% by mass.

14. The thermal transfer sheet according to claim 12, wherein the heat resistant slipping layer further comprises a metallic soap.

15. The thermal transfer sheet according to claim 11, wherein the heat resistant slipping layer further comprises a metallic soap.

16. The thermal transfer sheet according to claim 1, wherein the heat resistant slipping layer further comprises a linear polyethylene wax with a number average molecular weight of 1000 or larger.

17. The thermal transfer sheet according to claim 16, wherein the content of the linear polyethylene wax with a number average molecular weight of 1000 or larger in the heat resistant slipping layer is 1 to 50% by mass.

18. The thermal transfer sheet according to claim 17, wherein the heat resistant slipping layer further comprises a metallic soap.

19. The thermal transfer sheet according to claim 16, wherein the heat resistant slipping layer further comprises a metallic soap.

20. The thermal transfer sheet according to claim 1, wherein the heat resistant slipping layer further comprises a metallic soap.

* * * * *